United States Patent [19]

Small

[11] Patent Number: 4,511,908

[45] Date of Patent: Apr. 16, 1985

[54] PLASTIC IDENTIFICATION CARD HAVING FORGERY PROTECTION WITH RESPECT TO EMBOSSED INFORMATION

[75] Inventor: Edward A. Small, Nepean, Canada

[73] Assignee: British American Bank Note Inc., Ottawa, Canada

[21] Appl. No.: 579,013

[22] Filed: Feb. 10, 1984

[30] Foreign Application Priority Data

May 17, 1983 [CA] Canada ..... 428289

[51] Int. Cl.[3] ..... B41M 5/16

[52] U.S. Cl. ..... 346/206; 283/95; 283/904; 346/200; 346/226; 428/172; 428/199; 428/916

[58] Field of Search ..... 346/200, 206, 226; 428/172, 199, 914–916; 283/75, 95, 96, 904

[56] References Cited

U.S. PATENT DOCUMENTS 4,462,039 7/1984 Small ..... 346/206

*Primary Examiner*—Bruce H. Hess

*Attorney, Agent, or Firm*—Cushman, Darby & Cushman

[57] ABSTRACT

This invention relates to a plastic identification card with forgery protection with respect to embossed information. There is a problem with existing credit cards in that the forgers can change the embossed information. This problem is overcome by providing in registration with the embossed information a layer of chemicals reactive under the pressure of a change in the embossed information to release a colored dye.

12 Claims, 5 Drawing Figures

PLASTIC IDENTIFICATION CARD HAVING FORGERY PROTECTION WITH RESPECT TO EMBOSSED INFORMATION

This invention relates to a plastic identification card and particularly to a plastic identification card having forgery protection with respect to embossed information, particularly numbers. Plastic identification cards include credit cards and similar cards such as debit cards, insurance cards, transaction cards and the like. For convenience in the following description, the cards will be referred to as credit cards.

Conventional credit cards comprise a core stock, usually of plastic, such as polyvinyl chloride mylar or styrene, usually an embossed surface with the name, card number and other embossed or non-embossed information, such as conditions of use. At least one side is usually protected by a plastic layer such as a transparent polyvinyl chloride film or a coating such as acrylic polymer. Signature panels are often used, and copending Canadian Pat. application No. 411,820 filed Sept. 21, 1982 describes an improved signature panel using a layer of chemicals reactive under pressure to release a coloured dye conforming with the signature.

A problem with existing credit cards of the type referred to in the preceding paragraph is that forgers are now changing the embossment to alter the serial number or other embossed information. The forger uses pressure and heat to make this change. Other techniques are shaving and cut and paste. If this is skillfully done, it is difficult to detect. It has been common practice to circulate the serial numbers of lost or stolen cards and cards, the user of which is seriously in arrears. If the embossment is altered, the new serial number should not show up on the list.

The object of this invention is to increase the probability of detection when embossed numbers are changed in the foregoing manner.

In accordance with this invention, a layer of chemicals reactive under pressure to release a coloured dye conforming with the signature is provided in registration with the embossed information. Preferably such layer of chemicals is protected by the usual transparent plastic protective film. This layer of chemicals and the plastic protective film are applied before the embossing operation. Therefore this operation will cause the alpha numerics image to develop in the layer of chemicals. If then a forger attempts to alter the embossment, there will be a visible release of dye giving warning that tampering has occurred. This invention may be combined with the invention described in said Application 411,820 by enlarging the signature panel to include the embossed area.

In the drawings which illustrate the preferred embodiments:

Figure 1:
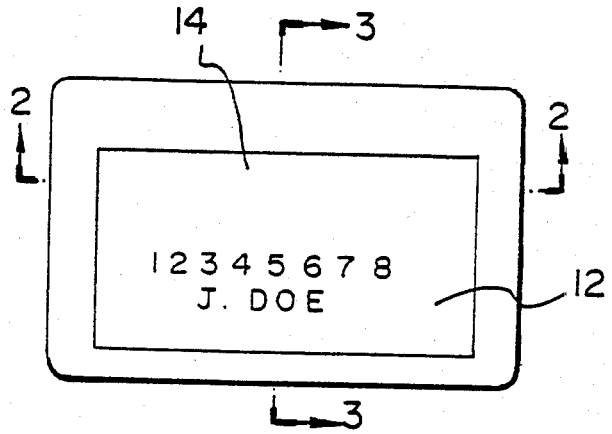
FIG. 1 is a plan view of the back of a credit card.
Figure 2:
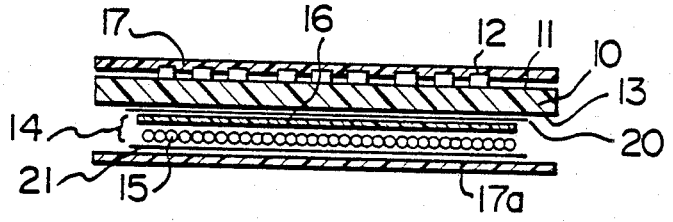
FIG. 2 is a section view of the line 2—2 of FIG. 1 with the layers separated for convenience of illustration.
Figure 3:
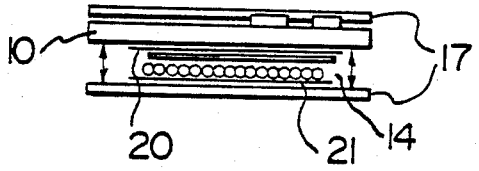
FIG. 3 is a similar section view on a line perpendicular to line 2—2.

The credit card illustrated in FIGS. 1, 2 and 3 comprises a core stock 10 having on its front surface 11 a transparent plastic film 17 and conventional embossments 12 providing information as to the serial number of the card and the name of the user. There may also be other embossed or non-embossed printing (not shown) on the face of the card. On the reverse side 13 of the core stock there is a signature panel 14 and an extension of such signature panel 14A. In this embodiment panel 14 and extension 14A comprises a capsule coat 15 and a receptive coat 16. Capsule coat 15 is a layer of colourless liquid encased in tiny capsules known as microcapsules. Under pressure the liquid is released from the capsules resulting in a localized chemical reaction within the receptive coat 16. The colourless liquid in the microcapsules are colour formers such as crystal violet lactone and/or benzoleucomathylene blue in solution in suitable colourless high boiling solvents. Crystal violet lactone undergoes a reaction in which the lactone ring is opened and a positive charge appears on one of the nitrogen atoms, thus forming the dyestuff known as crystal violet. Similarly, benzoleucomathylene blue will form a turquoise dye. There are now numerous proprietary colour formers that are commercially available. Various techniques are used for forming the microcapsules which may be classified under the headings coacervation, interface, polycondensation and solvent-induced polymer deposition. These are discussed in more detail in the general literature such as an article entitled "Chemical Carbonless Papers" a paper by J. M. Collins published in Professional Printer, Volume 24, No. 3 of 1981. The receptive coating may be a reactive clay which has been subjected to chemical treatment to provide reaction with the colour former, clays having added phenolic resins or zinc salicylate.

In FIGS. 1, 2 and 3, a plastic coating 17A, such as transparent polyvinyl chloride is then applied to the back surface of the core stock to cover not only the signature panel 14, but also the area in registration with embossment 12, namely, extension 14A. Preferably a plastic coating 17A covers some or all of the back of the card to provide a transparent layer. However, the signature panel and its extension is sandwiched between the core stock and the coating instead of being exposed on the outer surface as in previous practice. Although for convenience of illustration film 17 and coating 17A are shown in FIGS. 2 and 3 as being separate from the core stock 10, they will of course be firmly adhered thereto as shown by arrows in FIG. 3. An adhesive layer 20 secures the signature panel and extension to the core stock. A blocking layer 21 prevents the monomers from the acrylic coating from neutralizing the activated clay.

Figure 4:
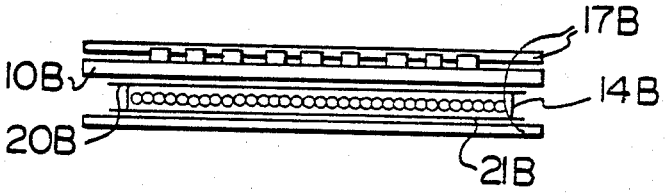
FIG. 4 is a similar section line to FIG. 2 illustrating an alternative embodiment of the invention.

FIG. 4 illustrates an alternative and preferred embodiment comprising a core stock 10B and a plastic coating 17B covering a signature panel and extension 14B. In this instance, signature panel and extension 14B comprises a single layer of reactive coating of the type used in self-imaging papers. Both the colour former and the chemical which reacts with the colour former to release the dye are in this single coating. As an example, 4 parts of a commercially available powder of the type used in self-imaging paper and which includes a mixture of colour former and reaction chemical such as the material sold by B.A.S.F. under the designation B.40, is mixed with 2 parts of activated clay which should have a particle size slightly greater than the capsules of the powder. A suitable clay is known under the trademark COPISIL. These are then mixed with 1 part of a solvent such as methanol and 3 parts of a mixture of resin binders such as the acrylic resin known under the trademark ACRONOL S320D and JONCRYL 85 in the ratio of 5:4. About 1 part of water is added to reduce the viscosity. The resultant mixture is then printed, preferably by screen printing, with a 160–200 mesh screen, to provide a signature patch on a core stock of plastic such as polyvinyl chloride, which core stock is preferably precoated with an adhesive such as an acrylic ethyl acetate 20A. The signature panel and its extension after printing is protected with a blocking compound 21A such as latex adhesive, activated clay and water in the ratio 7:1:2 to prevent monomers from the acrylic coating from neutralizing the activated clay in the signature panel. A transparent plastic coating, such as an acrylic resin is then applied to cover the signature patch. The core stock will typically have a thickness of 7 to 23 mil. The printed signature panel and extension will have a thickness of 2 to 5 microns. The blocking compound and acrylic outer coating are both applied by screen printing. The transparent coating may have a thickness of about 5 to 15 and preferably 10 microns. The acrylic resin coating on the signature panel should not be cured under undue heat or pressure, as this may cause discolouration. The preferred method is to use ultra violet light. But ultra violet light may cause bleaching of the dye unless a suitable blocking agent 21, 21A or 21B for the dye is selected.

Figure 5:
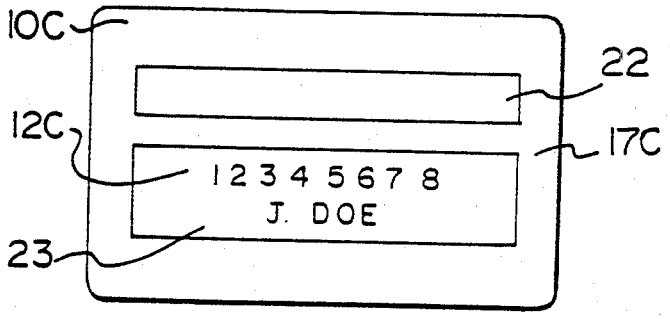
FIG. 5 is a plan view of an alternative embodiment of this invention.

The credit card in FIG. 5 has a core stock 10C covered by a protective layer of plastic 17C. It has a conventional signature panel 22 on the surface of plastic 17C, or as a further alternative, the signature panel may be omitted entirely. A layer of chemicals 23 is provided in registration with embossments 12C. These embossments are mechanically formed to cause a contrasting image development corresponding to the embossed information. Layer 23 releases a dye under pressure in the manner described in connection with FIGS. 1 to 3 or FIG. 4. In the event of attempted alteration, the image will be blurred or distorted, giving warning of tampering.

Each of the embodiments of this invention will therefore make it more difficult for a forger to alter the embossment without detection.

I claim:

1. An identification card comprising a core stock, having embossed information and at least one layer of chemicals reactive under pressure in registration with the embossments to form a coloured dye conforming with the original embossed information and a further formation of such dye when the embossed information is altered.

2. An identification card as in claim 1 in which a transparent plastic layer covers said layer of chemicals.

3. An identification card as in claim 2, having in addition a conventional signature panel on the surface of the transparent plastic.

4. An identification card as in claim 1 in which said layer of chemicals reactive under pressure comprise microcapsules.

5. An identification card as in claim 1, in which the layer of chemicals comprise chemicals reactive to form a dye in a single layer so as to be self-imaging.

6. An identification card as in claim 1, in which the layer of chemicals comprise a microcapsule coat and a receptive coat in registration with the microcapsule coat, a chemical in said microcapsule coat being reactive with a chemical in the receptive coat under pressure to form a coloured dye.

7. An identification card as in claim 1, in which said layer of chemicals is an extension of a signature panel including a layer of said chemicals.

8. An identification card as in claim 1, which is a credit card.

9. An identification card as in claim 1, in which an adhesive layer is interposed between the layer of chemicals and the core stock.

10. An identification card as in claim 1, in which a layer of blocking compound is interposed between the layer of chemicals and the transparent plastic layer covering it.

11. An identification card as in claim 1, in which an adhesive layer is interposed between the layer of chemicals and the core stock and in which a layer of blocking compound is interposed between the layer of chemicals and the transparent plastic layer covering it.

12. An identification card as in claim 1, in which the layer of chemicals is in registration with at least embossed distinctive alpha numeric information.

* * * * *